US008453757B2

(12) United States Patent
Lamprecht et al.

(10) Patent No.: US 8,453,757 B2
(45) Date of Patent: Jun. 4, 2013

(54) ADAPTER PART FOR A MACHINE TOOL

(75) Inventors: Justus Lamprecht, Dusslingen (DE); Sinisa Andrasic, Schoenaich (DE); Marcus Schuller, Dettenhausen (DE)

(73) Assignee: Robert Bosch GmbH, Stuttgart (DE)

( * ) Notice: Subject to any disclaimer, the term of this patent is extended or adjusted under 35 U.S.C. 154(b) by 284 days.

(21) Appl. No.: 12/736,503

(22) PCT Filed: Mar. 25, 2009

(86) PCT No.: PCT/EP2009/053531

§ 371 (c)(1), (2), (4) Date: Oct. 14, 2010

(87) PCT Pub. No.: WO2009/127505

PCT Pub. Date: Oct. 22, 2009

(65) Prior Publication Data

US 2011/0024148 A1 Feb. 3, 2011

(30) Foreign Application Priority Data

Apr. 18, 2008 (DE) ..... 10 2008 001 266

(51) Int. Cl.
*B25F 5/00* (2006.01)

(52) U.S. Cl.
USPC ..... 173/162.2; 173/170; 173/171

(58) Field of Classification Search
USPC ..... 173/170, 162.2, 171
See application file for complete search history.

(56) References Cited

U.S. PATENT DOCUMENTS

| | | | | |
|---|---|---|---|---|
| 5,361,853 | A * | 11/1994 | Takamura et al. | 173/217 |
| 5,898,379 | A | 4/1999 | Vanbergeijk | |
| 5,911,281 | A * | 6/1999 | Treskog et al. | 173/104 |
| 6,149,356 | A * | 11/2000 | Chu et al. | 408/56 |
| 6,176,412 | B1 * | 1/2001 | Weinger et al. | 227/142 |
| 6,263,607 | B1 * | 7/2001 | Fuchs et al. | 42/75.01 |
| 6,431,289 | B1 * | 8/2002 | Potter et al. | 173/47 |
| 6,502,949 | B1 | 1/2003 | Horiyama et al. | |
| 6,666,284 | B2 * | 12/2003 | Stirm | 173/97 |
| 7,422,133 | B2 * | 9/2008 | Nayrac et al. | 227/10 |
| 7,770,660 | B2 * | 8/2010 | Schroeder et al. | 173/217 |
| 2004/0148789 | A1 | 8/2004 | Gist et al. | |
| 2005/0188552 | A1 | 9/2005 | Gist et al. | |
| 2006/0201690 | A1 * | 9/2006 | Fehrle et al. | 173/170 |
| 2006/0258274 | A1 | 11/2006 | Oki et al. | |
| 2007/0256847 | A1 * | 11/2007 | Wan et al. | 173/217 |
| 2008/0135272 | A1 | 6/2008 | Wallgren et al. | |
| 2009/0126964 | A1 * | 5/2009 | Schroeder et al. | 173/217 |
| 2009/0194306 | A1 * | 8/2009 | Johnson et al. | 173/162.1 |

FOREIGN PATENT DOCUMENTS

| | | | |
|---|---|---|---|
| DE | 3147418 | A1 | 6/1983 |
| EP | 1281486 | A1 | 2/2003 |
| EP | 1378324 | A1 | 1/2004 |
| EP | 1714748 | A2 | 10/2006 |
| GB | 2321610 | A * | 8/1998 |
| GB | 2437822 | A | 11/2007 |
| WO | 2007058596 | A1 | 5/2007 |

* cited by examiner

*Primary Examiner* — Brian D Nash
(74) *Attorney, Agent, or Firm* — Maginot, Moore & Beck

(57) ABSTRACT

An adapter part for a machine tool is designed to be inserted between two housing parts and includes an adapter connection element that corresponds to a housing connection element on a housing part.

20 Claims, 3 Drawing Sheets

ADAPTER PART FOR A MACHINE TOOL

CROSS-REFERENCE TO RELATED APPLICATION

This application is a 35 USC 371 application of PCT/EP2009/053531 filed on Mar. 25, 2009.

BACKGROUND OF THE INVENTION

1. Field of the Invention

The invention relates to an adapter part for a power tool, in particular a hand-held power tool, and to a correspondingly embodied power tool.

2. Description of the Prior Art

Hand-held power tools such as drills, saws, angle grinders, or the like, have a drive unit in the form of an electric drive motor whose rotor shaft is rotatably connected via a transmission unit to a tool shaft functioning as a support for a tool. During operation of the hand-held power tool, significant mechanical stresses can occur that are caused on the one hand by oscillations of the drive motor, the transmission unit, the tool shaft, and the tool and on the other hand, are caused by the machining of the work piece, for example by means of impacts or hammering blows. The oscillations and vibrations can also lead to a significant noise load.

OBJECT AND ADVANTAGES OF THE INVENTION

The object of the invention is, through simple measures, to equip a power tool, in particular a hand-held power tool, with additional functionality. In particular, it should be easily possible, if the user so desires, to install and remove an oscillation damping element.

The adapter part according to the invention is suitable for use in a power tool, in particular a hand-held power tool such as an angle grinder, in which the housing of the power tool is composed of at least two parts and the two separate housing parts are coupled to each other by means of a connecting device. If the user so desires, the adapter part can be inserted between the two housing parts and for this purpose, has at least one adapter connecting element that is adapted to a housing connecting element provided on one of the two housing parts. It is thus possible, without additional measures such as the use of auxiliary tools, to insert the adapter part between the housing parts and to connect it to the relevant housing parts by means of the adapter connecting element. Since the adapter connecting element is suitably embodied to be the same as the housing connecting element, the connection between the housing part and adapter part is also produced in a way that corresponds to the direct connection between the housing parts when no adapter part is used.

This embodiment permits a quick installation and removal of the adapter part, making it possible to implement various functionalities in the adapter part. A functional element that produces the desired functionality is integrated into the adapter part. According to a first advantageous embodiment, the functional element is embodied in the form of an oscillation damping element and is used to reduce oscillation in the power tool. In addition or alternatively, though, it is also conceivable to use functional elements with other functionalities such as an illumination device for illuminating the work area, a measuring device, a control unit, or also a display unit for displaying various status variables or operating variables of the power tool such as the temperature. Functional elements in the form of cooling modules or blower units can also optionally be provided. According to a particularly simple embodiment, the adapter part is used only for extension, without performing an additional function; in this case, the functional element constitutes an extender part.

According to an advantageous embodiment, the functional element is embodied as a stand-alone component that is embodied separately from the adapter connecting element so that even inside the adapter part, it is easily possible to replace the functional element.

According to another advantageous embodiment, the adapter part is provided with an adapter ring on which the adapter connecting element is provided. The adapter ring simultaneously functions as the support for the functional element. Preferably, two parallel adapter rings spaced apart from each other are provided, between which the functional element is situated; the functional element suitably connects the two adapter rings to each other so that the two adapter rings and the functional element form a structural unit. This embodiment makes it possible to achieve an optimal damping in the axial direction.

It can be suitable for a section of the functional element to extend axially beyond the receiving groove and at least partially cover the outer circumference surface of the adapter ring. In the assembled state, this achieves an overlapping in the housing, in the region accommodating the adapter part.

According to another advantageous embodiment, the adapter ring is embodied as elastically deformable. This embodiment is particularly suitable for a functional element that is embodied in the form of an oscillation damping element since the inherent elasticity of the adapter ring results in a deformation in response to oscillations or impacts and these deformations are reduced in the oscillation damping element.

According to another suitable embodiment, the adapter ring is embodied in such a way that the adapter connecting element is situated in the region of an end surface of the adapter part on the radial outside of the adapter ring. In combination with an embodiment of the connecting elements in the form of detent elements, a detent engagement is achieved at this end surface between the adapter ring and the associated housing part. The advantage of this embodiment lies in the fact that an axial overlap between the end surface of the adapter ring and the adjacent housing part occurs, namely in the same way as the overlap between the directly assembled housing parts when no adapter part is used. Even with the adapter part, a fixed connection is achieved between the housing parts, with the quality of the connection being at least essentially the same as when there is a detent engagement directly between the housing parts.

Another advantage lies in the possibility of combining a plurality of adapter parts and assembling them to form one combined adapter part. In this instance, two or more adapter parts embodied identically to one another and situated one after another in the axial direction are assembled and are inserted between the two housing parts of the power tool. The individual adapter parts here either can have functional elements that are of the same type as one another or can have functional elements that differ from one another.

It can be useful to provide each of the two end surfaces of the adapter part with a respective adapter connecting element that corresponds to the respectively associated housing connecting element. It is also possible, however, to provide only one end surface of the adapter part with an adapter connecting element and to provide the opposite end surface with an adapter compensation element that is not brought into a connecting engagement with the housing connecting element oriented toward it, but instead encompasses the relevant housing connecting element in a cup-shaped fashion, thus achieving a compact embodiment in the axial direction. The connection at this end surface is suitably produced by means of a separate connecting device such as a screw connection.

Other advantages and suitable embodiments can be inferred from the remaining claims, the description of the figures, and the drawings themselves.

BRIEF DESCRIPTION OF THE DRAWINGS

The invention will be described in further detail below in conjunction with the accompanying drawings, in which.

DESCRIPTION OF THE PREFERRED EMBODIMENTS

Components that are the same from one drawing to the next are provided with the same references numerals.

Figure 1:
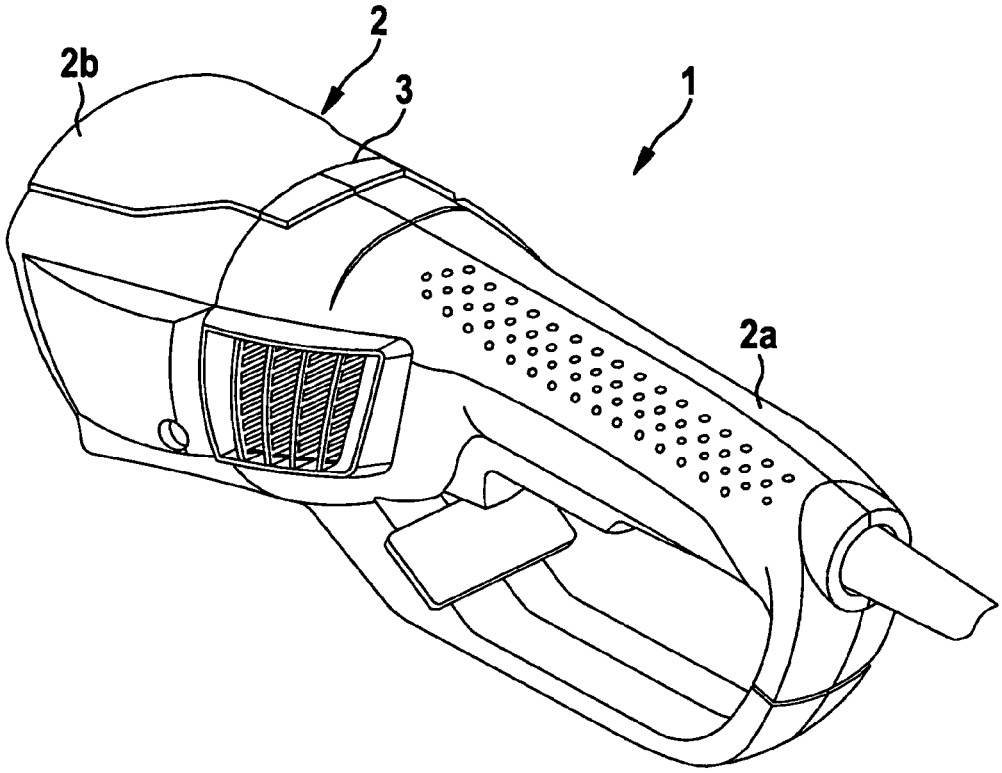
FIG. 1 is a schematic depiction of the two-part housing of a hand-held power tool, with a handle housing and a motor housing in the assembled position.
Figure 2:
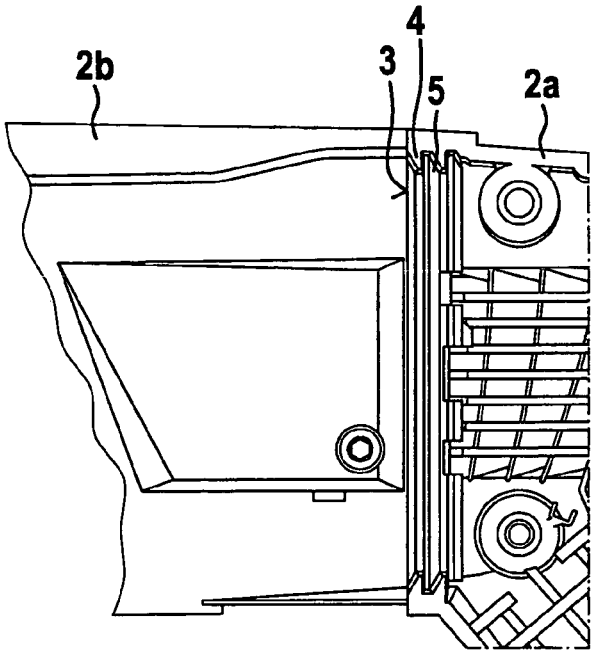
FIG. 2 is a sectional depiction of the connecting region between the housing parts.

As shown in FIG. 1, the housing 2 of the hand-held power tool 1, for example a grinding device such as an angle grinder, is divided in two and is composed of two housing parts 2*a* and 2*b* attached to each other in detachable fashion, of which the first housing part 2*a* constitutes a handle housing and the second housing part 2*b* constitutes a motor housing for accommodating an electric drive motor. The two housing parts 2*a* and 2*b* abut each other at a parting edge that is labeled with the reference numeral 3. The connection between the housing parts 2*a* and 2*b* preferably can be produced manually and without using an auxiliary tool, which also applies to the detachment of the two housing parts 2*a* and 2*b*.

In the assembled state, housing connecting elements, which are embodied in the form of housing detent elements 4 and 5 and are situated on the respective housing parts 2*a* and 2*b* in the region of end surfaces oriented toward each other, engage each other in detent fashion. The connection is produced by assembly in the radial direction so that in the axial direction, which simultaneously represents the detachment and assembly directions, there is a form-locked engagement between the housing detent elements 4 and 5. The housing part 2*a* constituting the handle housing is suitably divided in two in the axial direction, which offers the possibility of moving the two halves of the handle housing so that they approach the housing detent element 5 on the housing part 2*b* constituting the motor housing in the radial direction.

The housing detent element 5 on the housing part 2*b* is embodied in the form of an external thread while the housing detent element 4 on the housing part 2*a* is correspondingly embodied in the form of an internal thread. It is also possible, however, to produce a detent engagement with only an axial engaging motion, with no rotation around the longitudinal axis of the hand-held power tool.

Figure 3:
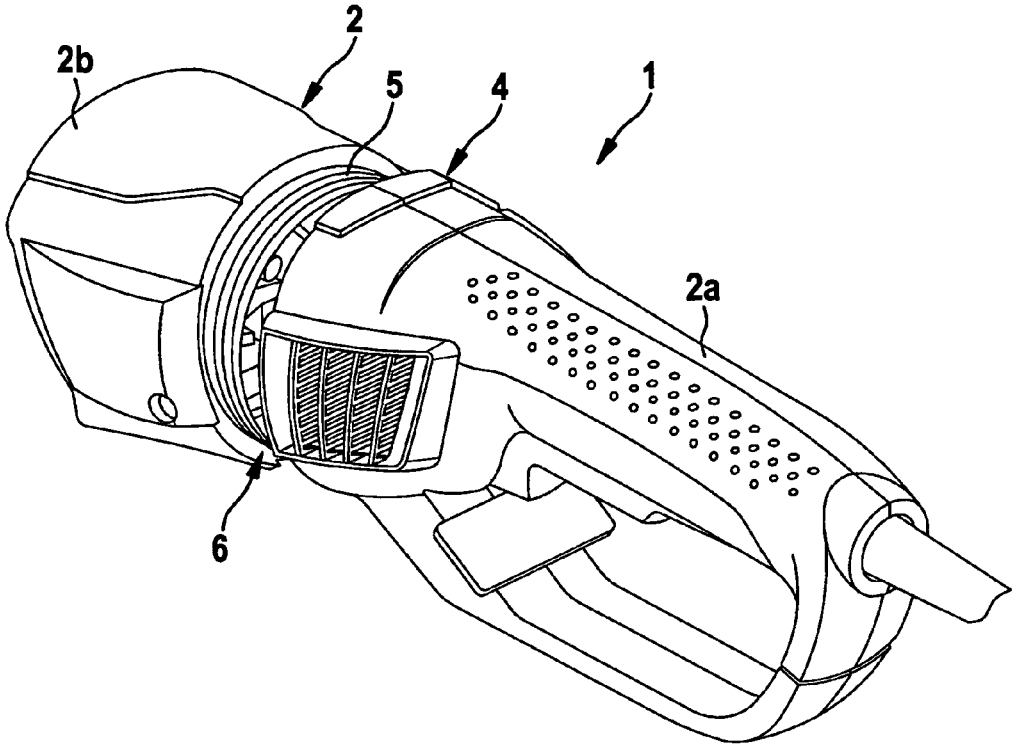
FIG. 3 shows the housing of the hand-held power tool, with the housing parts pulled apart from each other; the intermediate space between the housing parts can be used to accommodate an adapter part.

In FIG. 3, the housing parts 2*a* and 2*b* of the hand-held power tool 1 are shown spaced apart from each other in the axial direction, producing an intermediate space 6 between the housing parts into which an adapter part can be inserted. This adapter part is labeled with the reference numeral 7 in FIG. 4 and includes two parallel adapter rings 8*a* and 8*b*, which are spaced apart from each other axially, and one functional element 9 accommodated between the adapter rings 8*a*, 8*b*. The adapter part 7 can be inserted as needed into the intermediate space 6, thus increasing the overall length of the hand-held power tool 1. Depending on the selection of the functional element 9, the adapter part 7 performs various tasks. According to a preferred embodiment, the functional element 9 is embodied in the form of an oscillation damping element that reduces the oscillation load in the housing of the hand-held power tool. Other embodiments are also conceivable such as an embodiment of a functional element in the form of a support for an illumination device or an embodiment with sensors, a control unit, a display unit, or the like.

In the inserted position, the adapter part 7 performs a force-transmitting function between the two housing parts 2*a* and 2*b*. If the functional element 9 is embodied in the form of an oscillation damping element, it can be suitable for the adapter rings 8*a*, 8*b* extending between the housing parts 2*a* and 2*b* to have a minimum amount of inherent elasticity so that within strict limits, a relative movement between the housing parts 2*a* and 2*b* can occur, which is damped by the functional element 9. It is also possible, however, for the two adapter rings 8*a*, 8*b* to be made of a hard plastic and for the two adapter rings 8*a* and 8*b* to be connected axially to each other by means of the functional element 9, which is made of a soft, damping material.

In the region of its free axial end surface, the adapter ring 8*b* associated with the housing part 2*a* is provided with an adapter detent element 11 that is embodied in a way that corresponds to the housing detent element 4 on the housing part 2*a*, which is embodied in the form of a detent device that is oriented radially inward and equipped with a plurality of circumferential, parallel detent teeth or in the form of a thread. As a result, the adapter part 7 can be brought into a connecting or detent engagement position with the housing part 2*a*, namely in the same way as when the two housing parts are connected directly.

Figure 4:
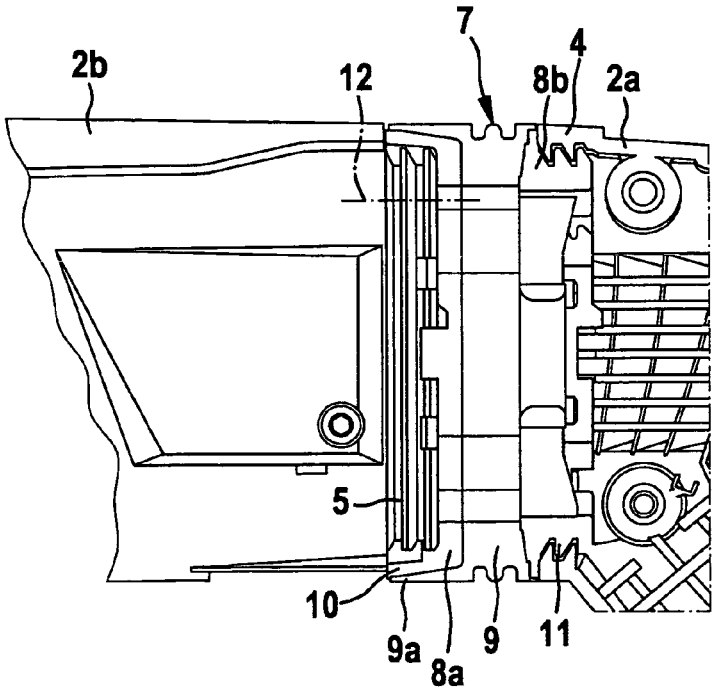
FIG. 4 is a sectional depiction, with an adapter part inserted between the two housing parts.

As shown in FIG. 4, the side of the adapter ring 8*a* oriented toward the housing part 2*b* is provided with an adapter compensation element 10 that is embodied in the form of a cup and encompasses the housing detent element 5, thus yielding a compact embodiment in the axial direction. The housing detent element 5 is embodied in the form of a detent device that extends radially outward, for example in the form of an external thread. A force-transmitting connection between the adapter compensation element 10 and the housing detent element 5 does not occur; instead, the connection between the adapter part 7 and the housing part 2*b* is produced by means of an additional connecting device 12 that is embodied for example in the form of a screw connection and can include a plurality of screws that are distributed around the circumference and are used to screw the adapter ring The adapter compensation element 10 can also optionally be embodied in the form of an adapter connecting element that is adapted to the associated housing detent element 5. In this case, the connecting device 12 is not required.

The functional element 9 has an axially protruding lip 9*a* that overlaps the adapter ring 8*a* in the region of the adapter compensation element 10, all the way to the end surface. Since the adapter detent element 11 at the opposite axial end is encompassed by the housing detent element 4 in the installed position, the functional element 9 therefore axially covers the entire intermediate space into which the adapter part 7 is inserted.

Figure 5:
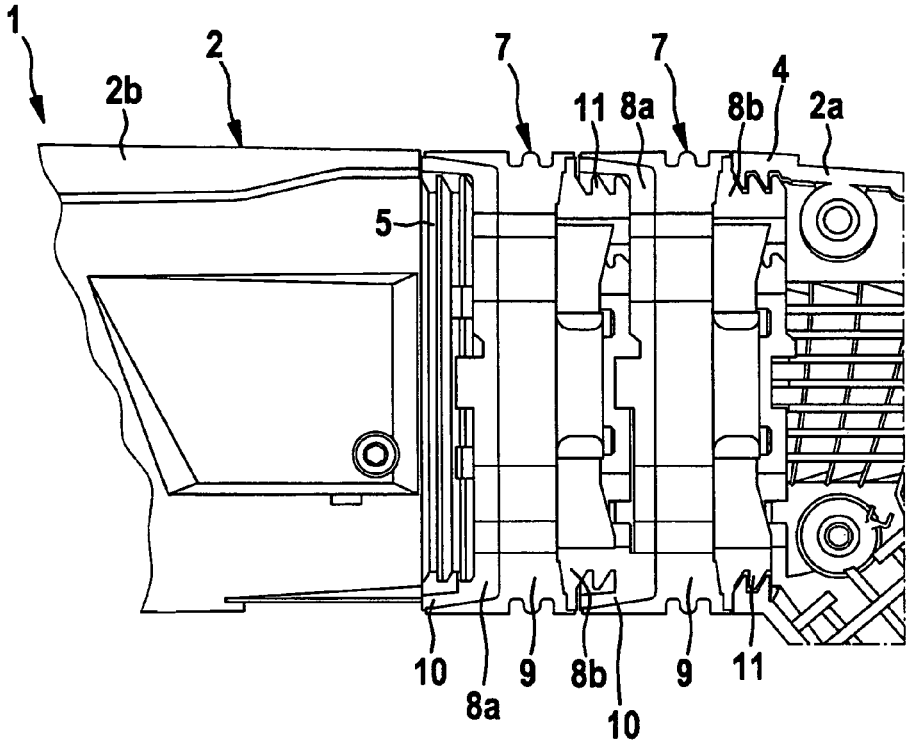
FIG. 5 is another sectional depiction, with two adapter parts inserted one after the other in the axial direction.
Figure 6:
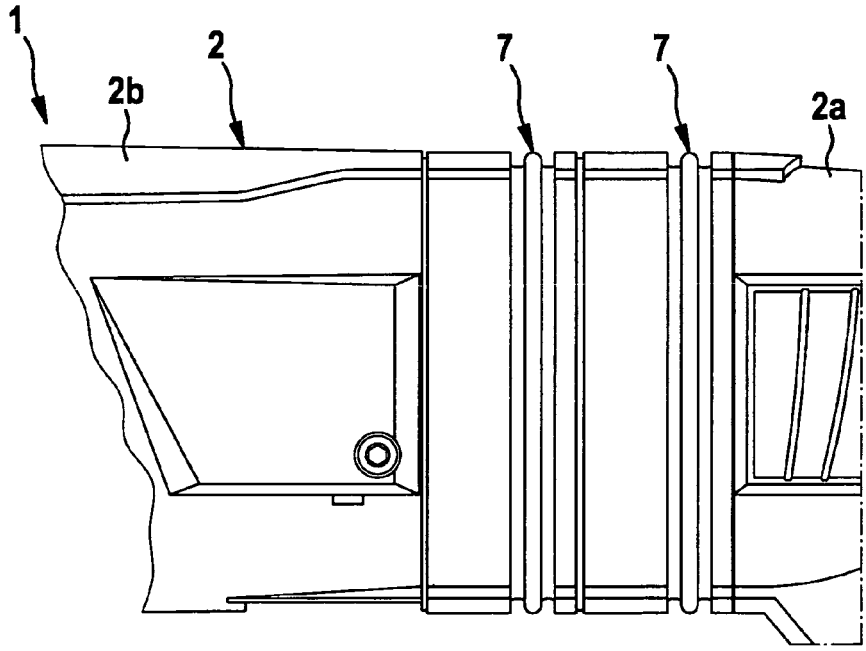
FIG. 6 is a side view of the housing according to FIG. 5.

FIGS. 5 and 6 show another exemplary embodiment in which two individual adapter parts 7 are inserted one after the other in the axial direction and connected to the two housing parts 2*a* and 2*b*. This produces a combined adapter part composed of the two individual adapter parts 7, which are embodied as identical to each other with regard to their dimensions and geometry and are each equipped with two adapter rings 8*a*, 8*b* and a functional element 9. The functional elements 9 in the two adapter parts can also differ from each other if so desired.

In the assembled position, the adapter compensation element 10 and the adapter detent element 11 in the region of the connection between the individual adapter parts 7 engage each other in detent fashion. The connection between the respective adapter detent elements and the respective housing parts 2*a* and 2*b* is produced as described above in connection with the exemplary embodiment according to FIG. 4.

The foregoing relates to the preferred exemplary embodiments of the invention, it being understood that other variants and embodiments thereof are possible within the spirit and scope of the invention, the latter being defined by the appended claims.

The invention claimed is:

1. An adapter part for a power tool, in particular a hand-held power tool, which has a housing for accommodating and holding a drive unit and tool, the housing having two separate housing parts to be connected to each other by means of a connecting device that includes housing connecting elements on the housing parts, a functional element being associated with the adapter part, the adapter part being provided for insertion between the two housing parts and having at least one adapter connecting element which is adapted to a housing connecting element and is to be brought into a connecting position with the housing connecting element, wherein the functional element is embodied as an oscillation damping element.

2. The adapter part as recited in claim 1, wherein the adapter connecting element is embodied as separate from the functional element.

3. The adapter part as recited in claim 2, wherein the adapter connecting element is connected to an adapter ring, which supports the functional element.

4. The adapter part as recited in claim 3, wherein the adapter ring is embodied as elastically deformable.

5. The adapter part as recited in claim 4, wherein the adapter connecting element is situated in a region of an end surface of a radial outside of the adapter ring.

6. The adapter part as recited in claim 3, wherein the adapter connecting element is situated in a region of an end surface of a radial outside of the adapter ring.

7. The adapter part as recited in claim 6, wherein in a region of an opposite end surface, an adapter compensation element is provided, which is adapted to an associated housing connecting element.

8. The adapter part as recited in claim 3, wherein in a region of an opposite end surface, an adapter compensation element is provided, which is adapted to an associated housing connecting element.

9. The adapter part as recited in claim 8, wherein the housing connecting element is situated on a radial outside of the housing part and the adapter compensation element encompasses the associated housing connecting element in a cup-shaped fashion.

10. The adapter part as recited in claim 3, wherein the functional element at least partially covers over an outer circumference surface of the adapter ring.

11. The adapter part as recited in claim 3, wherein two parallel adapter rings are provided and the functional element is situated between the adapter rings.

12. The adapter part as recited in claim 11, wherein the functional element connects the two adapter rings to each other.

13. The adapter part as recited in claim 1, wherein the functional element extends at least essentially over an axial length of the adapter part.

14. The adapter part as recited in claim 1, wherein the housing connecting element and the adapter connecting element are embodied as detent elements that are to be brought into a detent engagement position.

15. The adapter part as recited in claim 1, wherein a plurality of adapter parts are assembled to form a combined adapter part.

16. The adapter part as recited in claim 1, wherein the functional element further includes a measuring unit or a control unit.

17. The adapter part as recited in claim 1, wherein the functional element further includes a display unit.

18. An adapter part for a power tool, in particular a hand-held power tool, which has a housing for accommodating and holding a drive unit and tool, the housing having two separate housing parts to be connected to each other by means of a connecting device that includes housing connecting elements on the housing parts, a functional element being associated with the adapter part, the adapter part being provided for insertion between the two housing parts and having at least one adapter connecting element which is adapted to a housing connecting element and is to be brought into a connecting position with the housing connecting element, wherein the functional element includes an illumination device.

19. A power tool comprising:

a housing configured to accommodate and hold a drive unit and tool, the housing having two separate housing parts configured to be connected to each other by a connecting device that includes housing connecting elements on the housing parts, an adapter part including a functional element, the adapter part being located between the two housing parts and having at least one adapter connecting element which is configured to physically interact with one of the housing connecting elements, wherein the functional element is embodied as an oscillation damping element.

20. The power tool as defined in claim 19, further comprising an electric drive motor, wherein:

a first of the two separate housing parts defines a handle housing and a second of the two separate housing parts defines a motor housing in which the electric drive motor is positioned, and the adapter connecting element is configured separate from the functional element and includes two parallel adapter rings, and the functional element is interposed between the two parallel adapter rings.

* * * * *